US011576488B2

(12) United States Patent
Bushey

(10) Patent No.: US 11,576,488 B2
(45) Date of Patent: Feb. 14, 2023

(54) SURFACE PROTECTION DEVICE AND METHOD OF MOUNTING SAME

(71) Applicant: Bret L. Bushey, Mt. Pleasant, WI (US)

(72) Inventor: Bret L. Bushey, Mt. Pleasant, WI (US)

( * ) Notice: Subject to any disclaimer, the term of this patent is extended or adjusted under 35 U.S.C. 154(b) by 0 days.

(21) Appl. No.: 17/066,774

(22) Filed: Oct. 9, 2020

(65) Prior Publication Data

US 2021/0106136 A1 Apr. 15, 2021

Related U.S. Application Data

(60) Provisional application No. 62/913,388, filed on Oct. 10, 2019.

(51) Int. Cl.

| | |
|---|---|
| ***A47B 91/06*** | (2006.01) |
| ***A47B 91/12*** | (2006.01) |
| ***A47B 91/14*** | (2006.01) |

(52) U.S. Cl.

CPC ..... *A47B 91/06* (2013.01); *A47B 91/12* (2013.01); *A47B 91/14* (2013.01)

(58) Field of Classification Search

CPC ..... A47B 91/06; A47B 91/12; A47B 91/14; A47B 91/00; A47B 91/005

USPC ..... 248/188, 188.9, 501, 346.01; 16/42 R, 16/42 T, 18 R, 30

See application file for complete search history.

(56) References Cited

U.S. PATENT DOCUMENTS

| | | | | | |
|---|---|---|---|---|---|
| 176,668 | A * | 4/1876 | Muller | A47B 91/06 | 16/42 R |
| X336346 | | 2/1886 | Pratt | | |
| 630,128 | A * | 8/1899 | Stock | A47B 91/04 | 248/188.9 |
| 638,997 | A * | 12/1899 | Stock | A47B 91/04 | 248/188.9 |
| 667,630 | A * | 2/1901 | Garrett | F42B 6/003 | 473/572 |
| 698,228 | A * | 4/1902 | Scott | A47C 7/002 | 248/188.9 |
| 748,965 | A * | 1/1904 | Matlack | A47B 91/04 | 248/188.9 |
| 751,160 | A * | 2/1904 | Garrett | A47C 7/002 | 248/188.9 |
| 771,679 | A * | 10/1904 | Stock | A47B 91/04 | 248/188.9 |
| 1,123,960 | A * | 1/1915 | Von Der Lin | A47B 91/024 | 248/188.4 |
| 1,137,138 | A * | 4/1915 | Heron | A47B 91/04 | 248/188.9 |

(Continued)

*Primary Examiner* — Nkeisha Smith

(74) *Attorney, Agent, or Firm* — Boyle Fredrickson, S.C.

(57) ABSTRACT

A surface protection device and a method for mounting the same on a terminal end of a furniture leg are provided. The surface protection device is defined by a furniture glide including a furniture glide base having an upper surface directable towards the terminal end of the furniture leg and a lower surface interconnected by an outer periphery. A fastener extends from the furniture glide base along an axis and has a first end and a second end receivable in the terminal end of the furniture leg for frictionally connecting the furniture glide base to the furniture leg. A cup has an outer surface and an inner surface defining a cavity for receiving the furniture glide base therein. Matted material is molded into the outer surface of the cup.

28 Claims, 17 Drawing Sheets

(56) References Cited

U.S. PATENT DOCUMENTS 1,152,235 A * 8/1915 Stock ..... A47B 91/04 248/188.9
1,356,798 A * 10/1920 Stock ..... A47B 91/04 248/188.9
1,487,678 A * 3/1924 Gebhard ..... A47C 7/002 16/42 R
1,518,771 A * 12/1924 Campbell ..... A47B 91/04 16/42 R
1,522,878 A * 1/1925 Green ..... A47B 91/06 16/42 R
1,582,211 A 4/1926 Fleming
1,805,252 A * 5/1931 Miller ..... A47C 7/002 16/42 R
1,855,625 A * 4/1932 Raleigh ..... A47B 91/04 16/42 R
1,867,736 A 7/1932 Finkeldey
1,903,609 A 4/1933 Uhl
1,914,203 A 6/1933 Herold
1,981,728 A * 11/1934 Harris ..... A47C 7/002 16/42 R
1,988,377 A * 1/1935 Fruchter ..... A47B 91/04 248/346.11
2,030,649 A * 2/1936 Miller ..... A47B 91/04 16/42 R
2,140,541 A * 12/1938 Moore ..... A47C 7/002 16/42 R
2,262,063 A 11/1941 Swarr
2,262,064 A 11/1941 Swarr
2,476,366 A * 7/1949 Grimm ..... A47B 91/026 248/188.4
2,633,599 A 4/1953 Dolan
2,699,628 A 1/1955 Auer
2,738,541 A * 3/1956 Thornsbury ..... A47B 91/04 16/42 R
2,753,586 A 7/1956 Mertz
2,787,085 A 4/1957 Auer
2,794,205 A 6/1957 Skupas
2,820,240 A 1/1958 Matys
2,848,733 A 8/1958 Thornsbury
2,899,703 A 8/1958 Johnson
2,865,133 A 12/1958 Hoven et al.
2,876,485 A 3/1959 Cowles
2,878,509 A 3/1959 Fisher
2,933,754 A 4/1960 Winans
2,954,636 A 10/1960 Gammache
2,968,116 A * 1/1961 Arenson ..... A47C 7/002 248/188.9
2,973,545 A 3/1961 Kramcsak, Jr.
2,974,352 A 3/1961 Lockwood
2,988,770 A 6/1961 Arenson
2,992,509 A 7/1961 Gaenzle
3,025,631 A * 3/1962 Reynolds ..... A47B 91/06 248/188.9
3,050,770 A 8/1962 Morse et al.
3,059,267 A 10/1962 Wilhelmi
3,076,221 A 2/1963 Reynolds
3,183,545 A * 5/1965 Bergstrom ..... A47B 91/06 16/42 R
3,191,212 A 6/1965 Reiss, Sr. et al.
3,326,508 A * 6/1967 Born ..... A47B 91/06 248/346.11
3,342,445 A 9/1967 Bouwkamp
3,353,231 A 11/1967 Levine
3,362,040 A 1/1968 Gurzenda
3,366,991 A 2/1968 Le Vasseur
3,484,891 A 12/1969 Borgen
3,640,496 A 2/1972 Duncan
3,741,226 A 6/1973 Urban
3,883,923 A 5/1975 England
3,969,786 A 7/1976 Peak
3,994,043 A 11/1976 Gurzenda
4,313,586 A 2/1982 Grzesnikowski
4,327,461 A 5/1982 Wisniewski
4,468,910 A 9/1984 Morrison
D276,606 S 12/1984 Neuwirth
4,576,357 A 3/1986 Schrepfer
4,654,245 A 3/1987 Balzer et al.
4,793,580 A 12/1988 Richards
4,929,488 A * 5/1990 Livi ..... A47B 91/06 428/192
5,005,374 A 4/1991 Spitler
5,010,621 A 4/1991 Bock
5,042,764 A 8/1991 Carpinella et al.
5,057,356 A 10/1991 Smith
5,081,740 A 1/1992 Smith
5,170,972 A 12/1992 Casals Guell
5,220,705 A 6/1993 Bushey
D339,560 S 9/1993 Byrd
5,287,595 A 2/1994 Stevens, Jr.
D348,985 S 7/1994 Walker
D353,505 S 12/1994 Rea
5,426,818 A 6/1995 Bushey
D368,022 S 3/1996 Angle
5,557,824 A 9/1996 Bushey
5,573,212 A * 11/1996 Palazzolo ..... A47B 91/06 248/188.9
5,573,213 A 11/1996 Henderson et al.
D376,944 S 12/1996 Dunn
5,581,844 A 12/1996 Raheb et al.
5,591,974 A 1/1997 Troyer et al.
5,603,141 A 2/1997 Gledhill
D381,865 S 8/1997 Gallagher
5,680,673 A * 10/1997 Beshore ..... A47B 91/06 16/42 R
5,689,853 A 11/1997 Lemmer
5,782,444 A * 7/1998 Anderman ..... A47B 91/06 248/188.4
D400,088 S 10/1998 Hurrie
6,154,923 A 12/2000 Carpinella
6,186,453 B1 2/2001 Redbone
6,280,817 B1 8/2001 McCrossin et al.
6,295,697 B1 10/2001 Simon
6,324,725 B1 12/2001 Green
6,354,231 B1 3/2002 Morris
D455,383 S 4/2002 Sneed
6,405,982 B2 * 6/2002 Ferencz ..... A47B 91/06 248/188.9
6,626,405 B1 * 9/2003 Keast ..... A47B 91/06 16/42 R
6,866,913 B2 * 3/2005 Hanes ..... A47B 91/06 428/99
D513,169 S 12/2005 Bushey
7,231,690 B2 6/2007 Bushey
7,234,199 B2 6/2007 Bushey
7,533,858 B2 * 5/2009 Straus ..... A47B 91/06 248/188.2
8,037,574 B2 * 10/2011 Chase ..... A47B 91/06 16/42 R
8,438,701 B2 * 5/2013 Bushey ..... A47B 91/06 16/42 T
8,621,711 B2 * 1/2014 Wagner ..... A47B 91/06 16/42 R
9,962,000 B2 * 5/2018 Rondina ..... A47B 91/12
9,968,194 B2 * 5/2018 Bushey ..... A47B 91/06
10,231,542 B2 * 3/2019 Wang ..... A47B 91/06
2001/0040206 A1 * 11/2001 Ferencz ..... A47B 91/12 248/346.11
2003/0163894 A1 9/2003 Jones et al.
2004/0093687 A1 * 5/2004 Bushey ..... A47C 7/002 16/17.1
2005/0034268 A1 2/2005 Wurdack
2005/0081330 A1 * 4/2005 Edwards ..... A47B 91/06 16/42 R
2005/0115022 A1 6/2005 Desmarais
2005/0253031 A1 * 11/2005 Bushey ..... B29C 43/02 248/188.9
2007/0089266 A1 * 4/2007 Beshore ..... A47C 7/002 16/42 R
2008/0042025 A1 * 2/2008 Brouard ..... A47B 91/06 248/188.9

(56) References Cited

U.S. PATENT DOCUMENTS

| | | | | |
|---|---|---|---|---|
| 2008/0099639 | A1* | 5/2008 | Webster | A47B 91/06<br>248/188.9 |
| 2008/0148522 | A1* | 6/2008 | Beshore | A47B 91/16<br>16/42 R |
| 2008/0178430 | A1* | 7/2008 | Berthiaume | A47B 91/12<br>16/42 T |
| 2008/0258023 | A1 | 10/2008 | Desmarais | |
| 2010/0018005 | A1* | 1/2010 | Bushey | A47B 91/06<br>16/42 T |
| 2012/0047688 | A1* | 3/2012 | Belec | A47B 91/06<br>16/42 R |

* cited by examiner

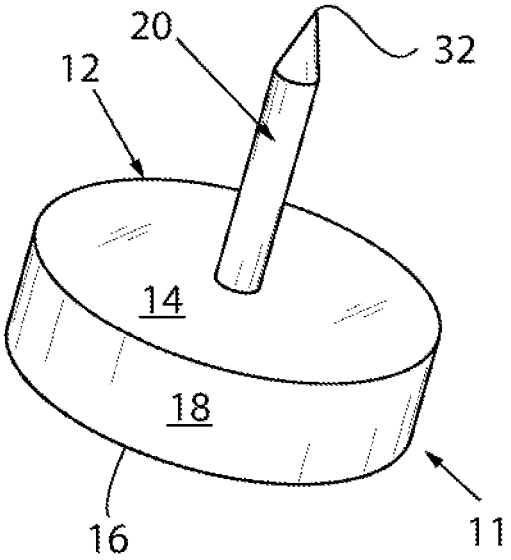
FIG. 5
FIG. 6
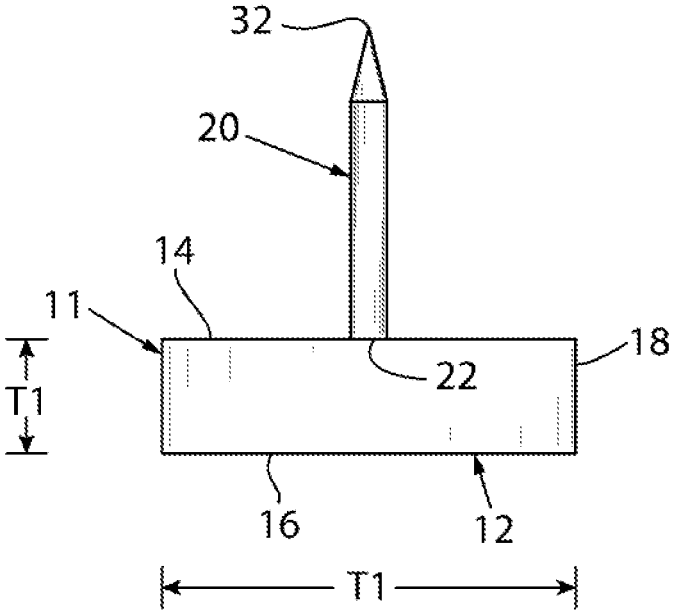

SURFACE PROTECTION DEVICE AND METHOD OF MOUNTING SAME

CROSS-REFERENCE TO RELATED APPLICATION

This application claims benefit from U.S. Provisional Application No. 62/913,388, filed Oct. 10, 2019.

FIELD OF THE INVENTION

This invention relates generally to furniture glides, and in particular, to a surface protection device that is mountable on the terminal end of a furniture leg of a piece of furniture and retained thereon as the piece of furniture is slid over a supporting surface.

BACKGROUND OF THE INVENTION

Coasters are often used under the legs of a piece of furniture to act as a buffer between the legs and the floor on which the piece of furniture rests. Typically, coasters take the form of glass or rubber discs having flat bottoms that rest on the floor. By positioning the coasters between the furniture legs and the floor, the weight of the furniture leg is dispersed over a larger area such that the furniture leg does not scratch or mar the floor when the piece of furniture is moved or leave a depression in the floor when the piece of furniture remains in one place for an extended period of time.

In addition, furniture glides or sliders have been developed that are also positioned between the legs of a piece of furniture and the carpeting on which the piece of furniture rests. By way of example, Bushey, U.S. Pat. No. 5,220,705, discloses a furniture glide that facilitates the movement of a piece of furniture on carpeted and bare floors. The furniture glide includes a convo-convex disc having an arcuate convex lower surface, a concave upper surface defining a central cavity, and resilient pad fixed to the disc upper surface within the central cavity below the edge thereof. Adhesive is provided for securing the resilient pad to the bottom of the piece of furniture or to the leg of the piece of furniture.

While functional for its intended purpose, the furniture glide disclosed in the Bushey '705 patent has certain limitations. More specifically, repeated movement of a piece of furniture along a floor may cause the adhesive to fail such that the resilient pad becomes detached from the bottom of the piece of furniture. As a result, the furniture glide may become separated from the piece of furniture such that the bottom of piece of furniture may engage and damage the flooring. Therefore, it is highly desirable to provide a furniture glide and/or coaster that may be simply secured to a bottom of a piece of furniture to prevent damage to the flooring on which the piece of furniture rests.

Alternatively, Bushey, U.S. Pat. No. 7,234,199 discloses a furniture glide for mounting on the terminal end of a furniture leg having an outer surface. The furniture glide includes a base having a generally arcuate lower surface for engaging a supporting surface. A sleeve extends from the base and defines a cavity for receiving the furniture leg therein. The sleeve includes a leg engagement element for engaging the furniture leg received within the cavity and for allowing the furniture leg to be supported within the cavity at an angle thereto. However, the addition of the sleeve to the furniture glide substantially increases the overall cost of such glide.

Therefore, what is needed is an improved surface protection device which can be mounted securely to a terminal end of a furniture leg without one or more of the aforementioned drawbacks.

Therefore, it is a primary object and feature of the present invention, a surface protection device is provided for mounting on a terminal end of a furniture leg. The surface protection device includes a furniture glide base having an upper surface directable toward the terminal end of the furniture leg and a lower surface interconnected by an outer periphery. A fastener extends from the furniture glide base along an axis and has a first end and a second end receivable in the terminal end of the furniture leg for frictionally connecting the furniture glide base to the furniture leg. A end cap is receiveable on the furniture glide base. The end cap includes an end cap base having an upper surface, a lower surface and an outer periphery. A sidewall extends from the outer periphery of the end cap base and has an inner surface defining a cavity adapted for receiving the furniture glide base therein. A matted material is molded into the lower surface of the base and the outer surface of the sidewall.

The furniture glide base may have a generally circular configuration and a diameter. The cavity of the end cap has a diameter. The diameter of the end cap is generally equal to the diameter of the furniture glide base. The sidewall of the end cap includes an outer surface. The inner and outer surfaces of the end cap may be generally parallel. An adhesive may be provided on the upper surface of the base. The adhesive is engageable with the lower surface of the furniture glide base. The sidewall may be fabricated from an elastic material.

The sidewall terminates at a terminal edge. A flange extends from the inner surface of sidewall adjacent the terminal edge. The flange terminates at a radially inner edge defining an opening to the cavity in the end cap. The flange is defined by a first upper surface generally coplanar with the terminal edge of the sidewall and a second lower surface. The first upper surface of the flange and the second lower surface of the flange converge toward each other as the flange extends from the inner surface of the sidewall. The first end of the fastener is captured in the furniture glide base.

A spacer may be receivable on the upper surface of the furniture glide base. The spacer is configured to space the upper surface of the furniture glide base from the terminal end of the furniture leg when the fastener frictionally connects the furniture glide base to the furniture leg. Alternatively, a spacer may be integrally formed on the upper surface of the furniture glide base. The spacer is configured to space the upper surface of the furniture glide base from the terminal end of the furniture leg when the fastener frictionally connecting the furniture glide base to the furniture leg.

In accordance with a further aspect of the present invention, a surface protection device is provided for mounting on a terminal end of a furniture leg. The surface protection device includes a furniture glide defined by a furniture glide base having an upper surface directable towards the terminal end of the furniture leg and a lower surface interconnected by an outer periphery. A fastener extends from the furniture glide base along an axis and has a first end and a second end receivable in the terminal end of the furniture leg for frictionally connecting the furniture glide base to the furniture leg. A cup has an outer surface and an inner surface defining a cavity for receiving the furniture glide base therein. Matted material is molded into the outer surface of the cup. The first end of the fastener may be captured in the furniture glide base.

The cup includes a base portion having an upper surface, a lower surface and an outer periphery. A sidewall extends from the outer periphery of the base and has an inner surface and an outer surface. The sidewall of the cup is fabricated from an elastic material. The inner and outer surfaces of the sidewall of the cup may be generally parallel and may have a generally uniform thickness. An adhesive may be provided on the upper surface of the base. The adhesive is engageable with the lower surface of the furniture glide base. The sidewall terminates at a terminal edge. A flange extends from the inner surface of sidewall adjacent the terminal edge. The flange terminates at a radially inner edge defining an opening to the cavity in the cup. The flange is defined by a first upper surface generally coplanar with the terminal edge of the sidewall and a second lower surface. The first upper surface of the flange and the second lower surface of the flange converge toward each other as the flange extends from the inner surface of the sidewall.

A spacer may be receivable on the upper surface of the furniture glide base. The spacer is configured to space the upper surface of the furniture glide base from the terminal end of the furniture leg when the fastener frictionally connecting the furniture glide base to the furniture leg. Alternatively, the spacer may be integrally formed on the upper surface of the furniture glide base. The spacer is configured to space the upper surface of the furniture glide base from the terminal end of the furniture leg when the fastener frictionally connecting the furniture glide base to the furniture leg.

In accordance with a still further aspect of the present invention, a method of interconnecting a surface protection device to a terminal end of a piece of furniture is provided. The method includes the steps of interconnecting an end cap to a furniture glide and interconnecting the furniture glide to the terminal end of the piece of furniture.

The furniture glide includes a furniture glide base having an upper surface directed towards the terminal end of the furniture leg and a lower surface interconnected by an outer periphery. A fastener extends from the furniture glide base along an axis and has a first end and a second end receivable in the terminal end of a piece of furniture to frictionally interconnect the furniture glide base to the terminal end of a piece of furniture. The first end of the fastener may be captured in the furniture glide base.

The end cap includes an end cap base having an upper surface, a lower surface and an outer periphery. A sidewall extends from the outer periphery of the end cap base and has an inner surface defining a cavity adapted for receiving the furniture glide base therein. The sidewall of the end cap is fabricated from an elastic material. A matted material is molded into the lower surface of the base and the outer surface of the sidewall. The inner and outer surfaces of the sidewall of the end cap may be generally parallel and may have a generally uniform thickness. An adhesive is provided on the upper surface of the base. The adhesive is engageable with the lower surface of the furniture glide base.

The sidewall terminates at a terminal edge and a flange extends from the inner surface of sidewall adjacent the terminal edge. The sidewall of the end cap is fabricated from an elastic material. The flange terminates at a radially inner edge defining an opening to the cavity in the end cap. The flange is defined by a first upper surface generally coplanar with the terminal edge of the sidewall and a second lower surface. The first upper surface of the flange and the second lower surface of the flange converge toward each other as the flange extends from the inner surface of the sidewall.

A spacer may be positioned on the upper surface of the furniture glide base. The spacer is configured to space the upper surface of the furniture glide base from the terminal end of a piece of furniture when interconnected. Alternatively, the spacer may be integrally formed on the upper surface of the furniture glide base. The spacer is configured to space the upper surface of the furniture glide base from the terminal end of a piece of furniture when interconnected.

BRIEF DESCRIPTION OF THE DRAWINGS

The drawings furnished herewith illustrate a preferred methodology of the present invention in which the above advantages and features are clearly disclosed as well as others which will be readily understood from the following description of the illustrated embodiment.

In the drawings:

FIG. 5 is an isometric view of a furniture glide for the surface protection device of the present invention;

FIG. 6 is a side elevational view of the furniture glide of FIG. 5;

DETAILED DESCRIPTION OF THE DRAWINGS

Figure 12:
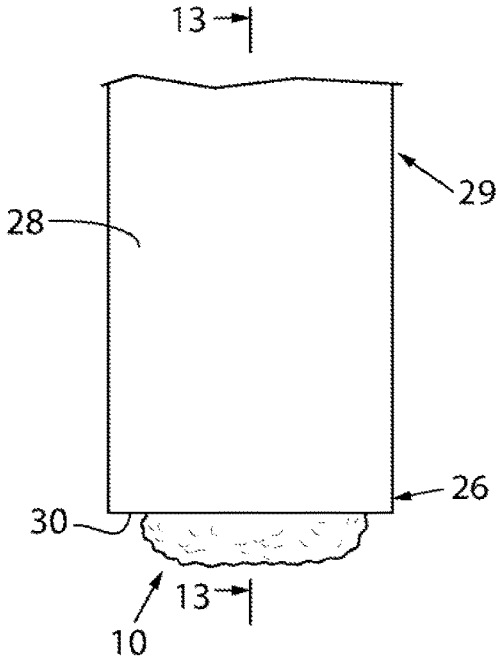
FIG. 12 is a side elevational view of the surface protection device mounted on the furniture leg.

Referring to FIGS. 1-4, a floor/surface protection device in accordance with the present invention generally designated by the reference numeral 10. Surface protection device 10 includes a furniture glide 11, FIG. 5-6, defined by a generally disc-shaped base 12 having a generally flat upper surface 14 and a generally flat lower surface 16 interconnected by outer peripheral edge 18. A fastening mechanism, such as nail 20, projects vertically from center 22 of upper surface 14 along a corresponding axis. Nail 20 includes head 24. FIGS. 6 and 12, captured within the interior of base 12 so as to interconnect nail 20 thereto.

Figure 1:
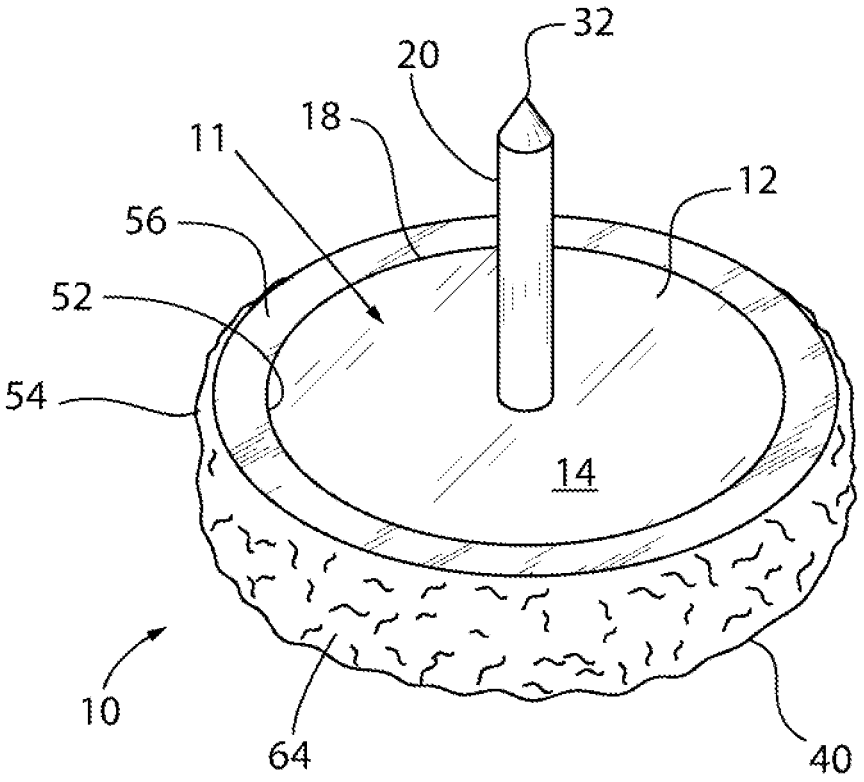
FIG. 1 is an isometric view of a surface protection device in accordance with the present invention.
Figure 2:
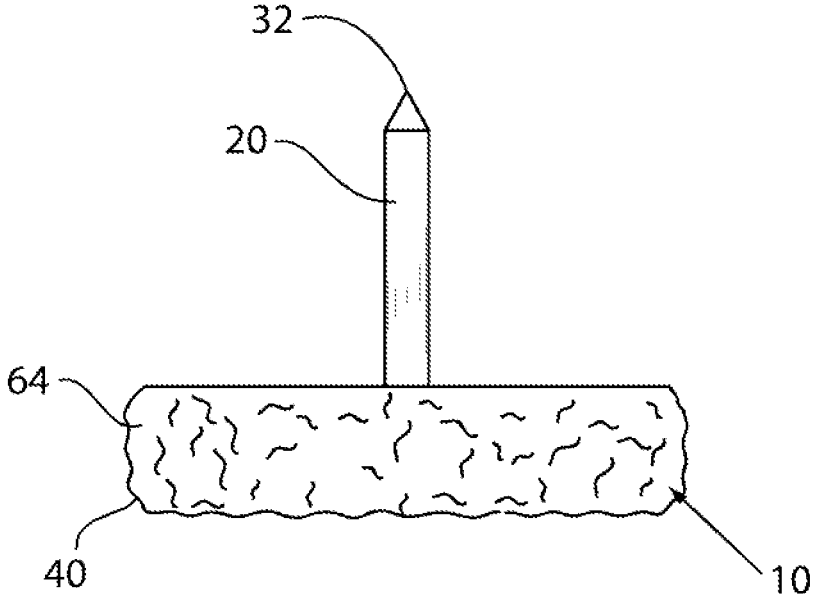
FIG. 2 is a side elevational view of the surface protection device of FIG. 1.
Figure 3:
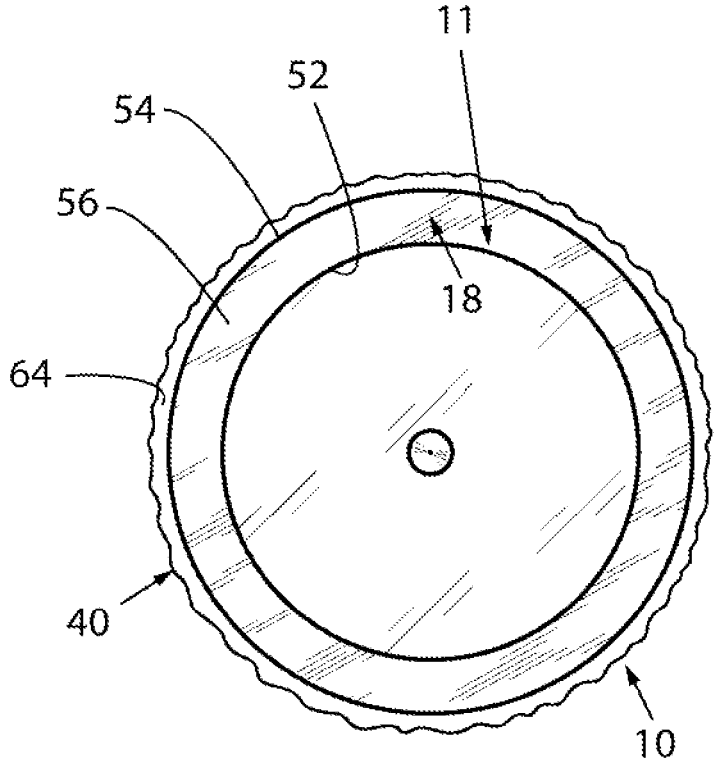
FIG. 3 is a top plan view of the surface protection device of FIG. 1.
Figure 4:
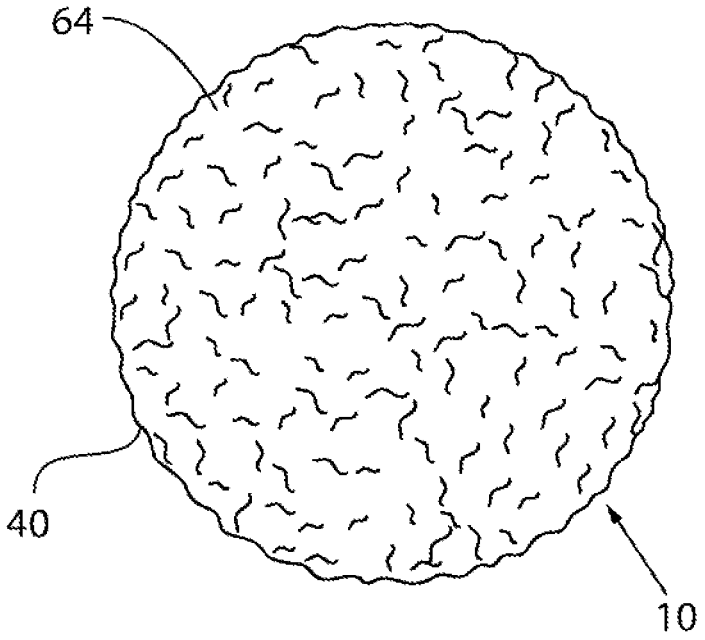
FIG. 4 is a bottom plan view of the surface protection device of FIG. 1.
Figure 7:
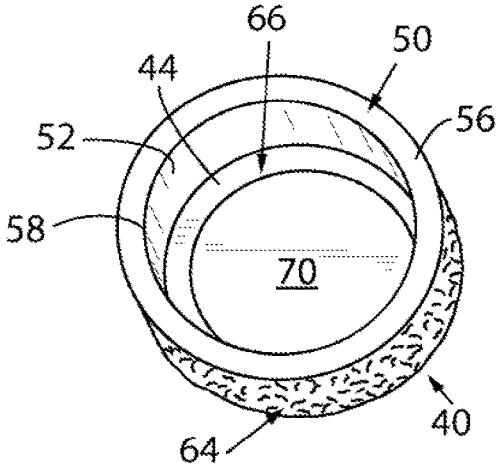
FIG. 7 is an isometric view of an end cap for the surface protection device of the present invention.
Figure 8:
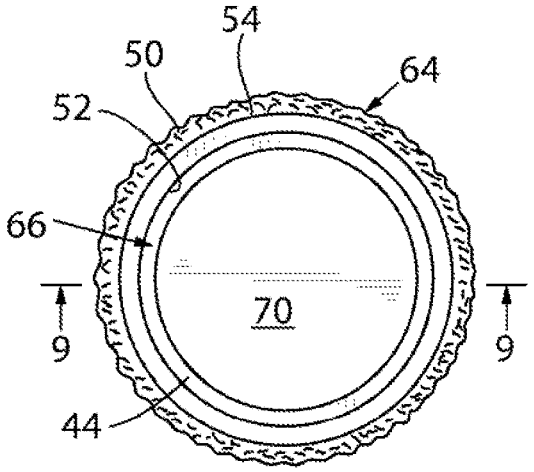
FIG. 8 is a top plan view of the end cap of FIG. 7.
Figure 9:
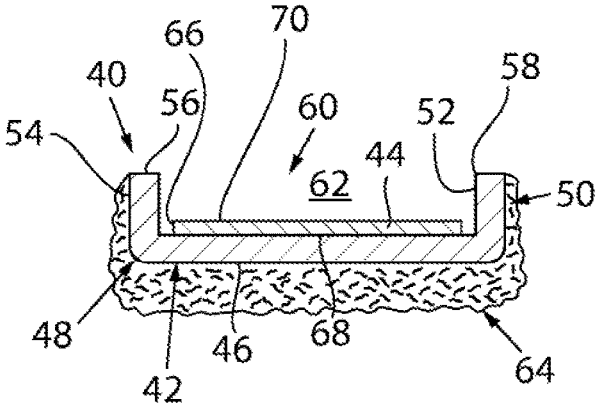
FIG. 9 is a cross-sectional view of the end cap taken along line 9-9 of FIG. 8.
Figure 10:
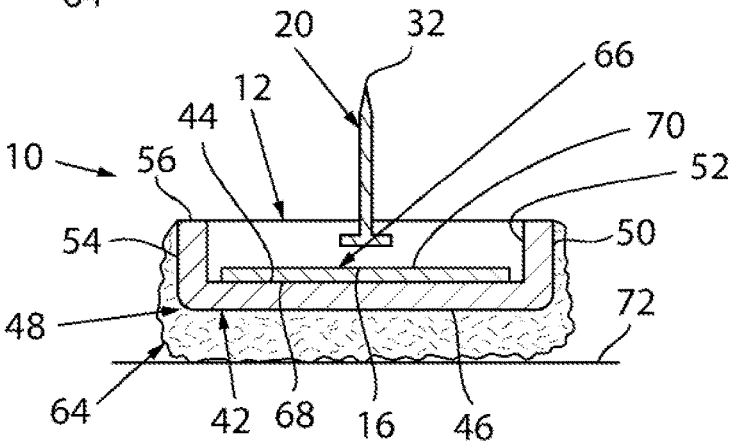
FIG. 10 is a cross-sectional view of the end cap, similar to FIG. 9, showing the end cap mounted on the furniture glide of FIG. 5.
Figure 11:
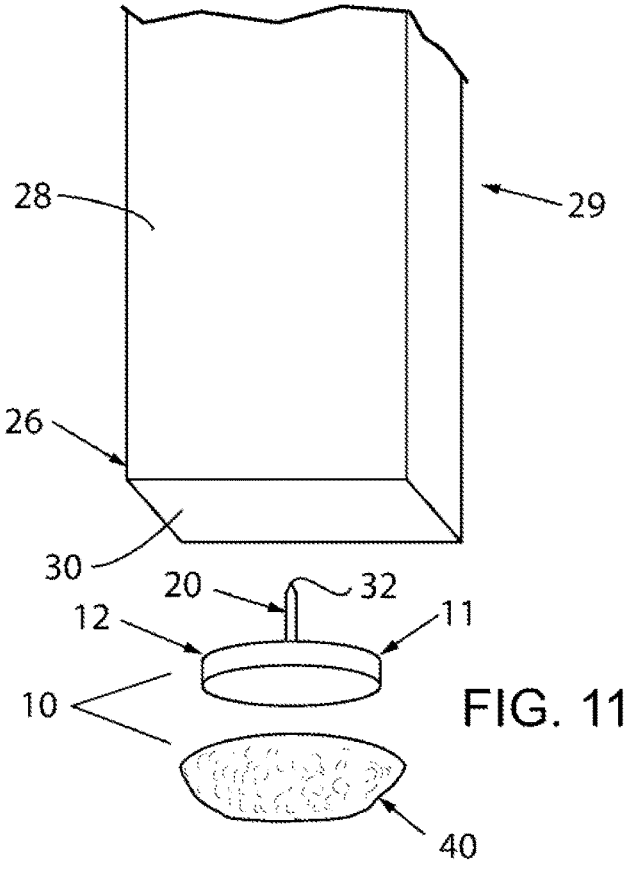
FIG. 11 is an exploded isometric view of the surface protection device of FIG. 1 and a furniture leg to which the surface protection device is to be mounted.
Figure 13:
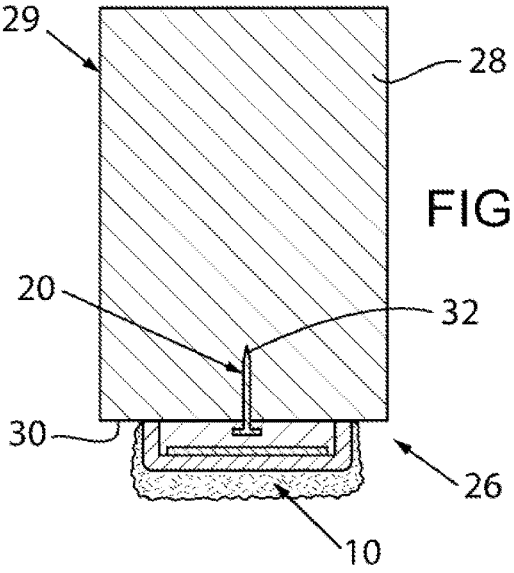
FIG. 13 is a cross-sectional view of the surface protection device mounted on the furniture leg taken along line 13-13 of FIG. 12.
Figure 14:
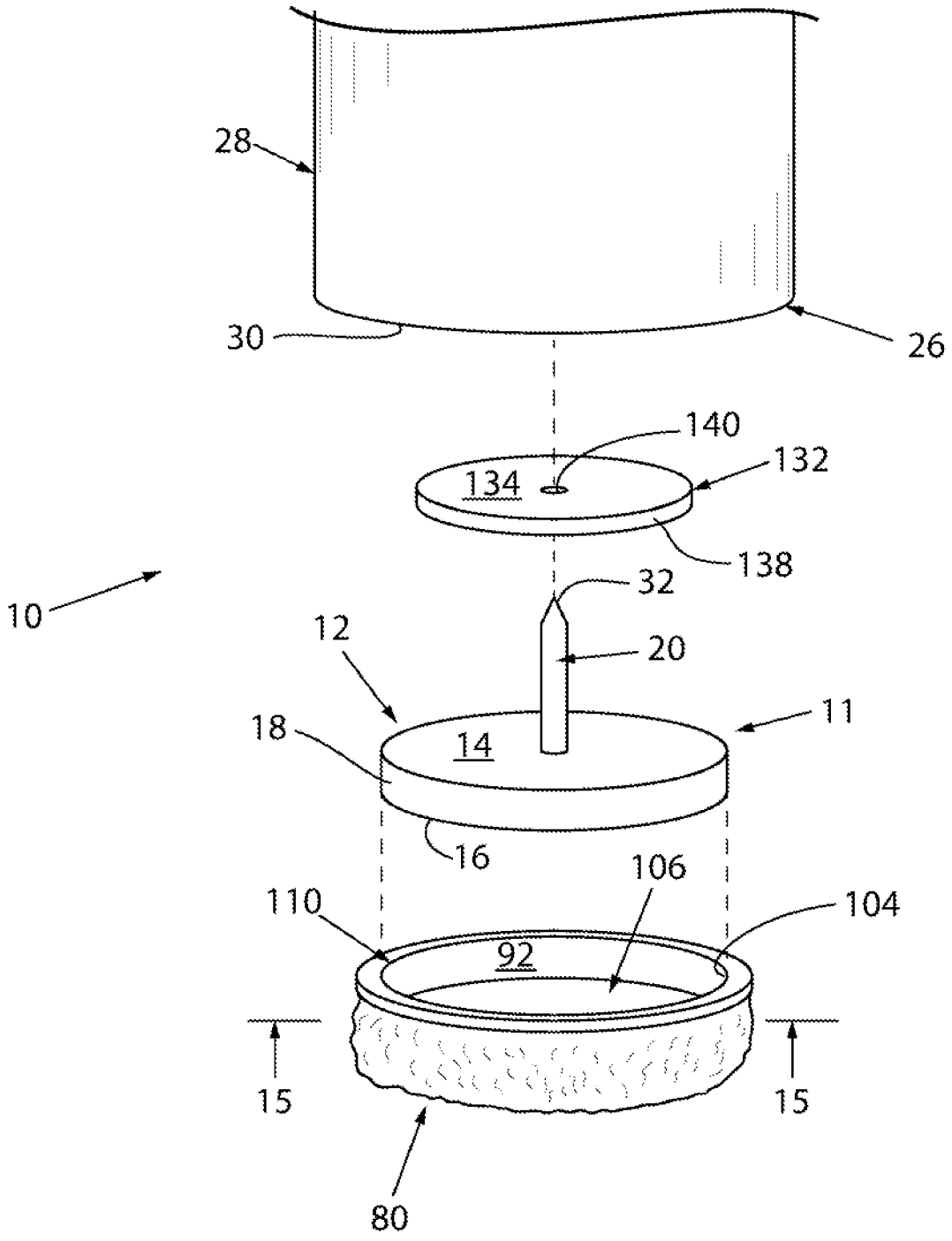
FIG. 14 is an exploded, isometric view the surface protection device of the present invention including an alternate configuration of an end cap.
Figure 15:
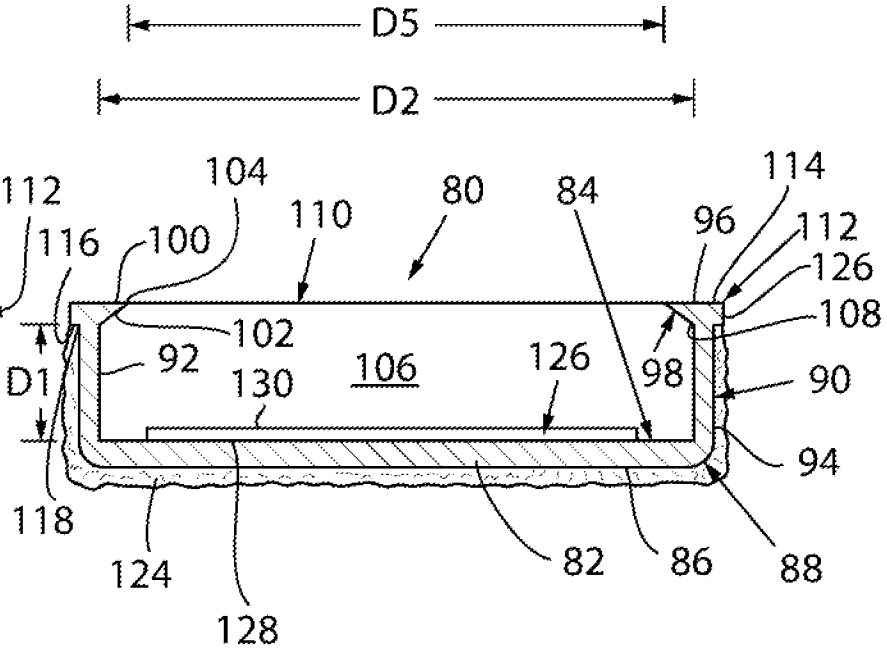
FIG. 15 is a cross-sectional view of the alternate configuration of the end cap for the surface protection device of the present invention taken along line 15-15 of FIG. 14.
Figure 17:
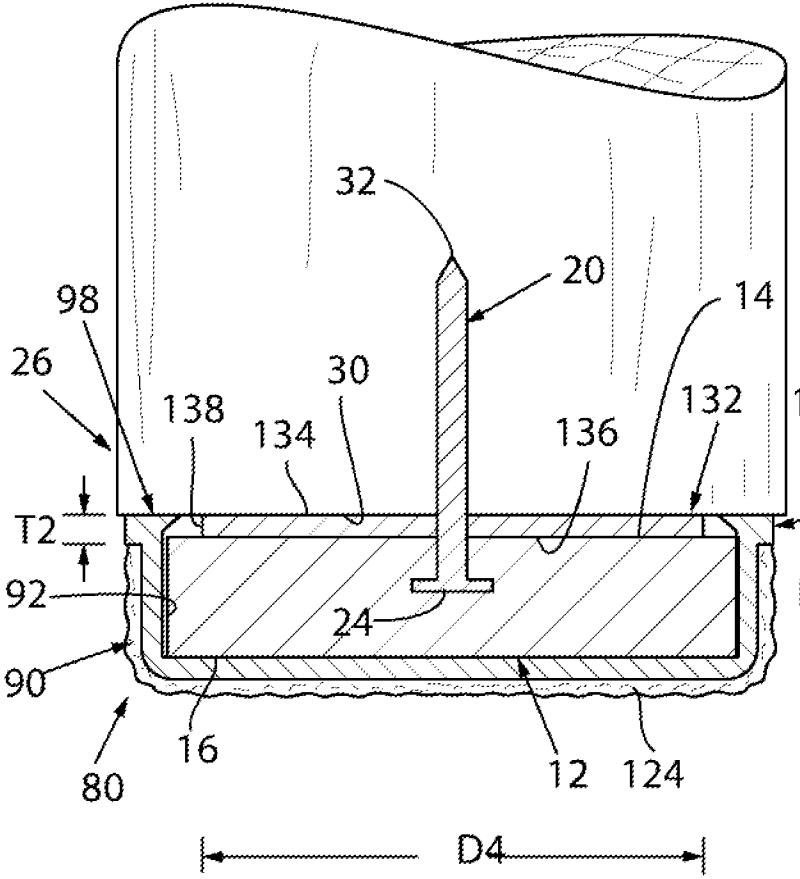
FIG. 17 is a cross-sectional view of the surface protection device of the present invention taken along line 17-17 of FIG. 16.
Figure 16:
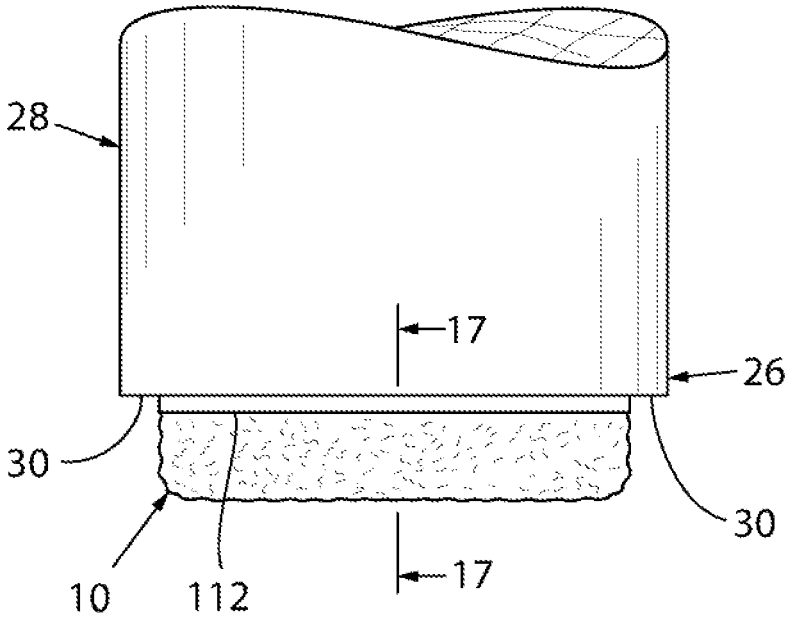
FIG. 16 is a side elevational view of the surface protection device of FIG. 14 mounted on the furniture leg.
Figure 18:
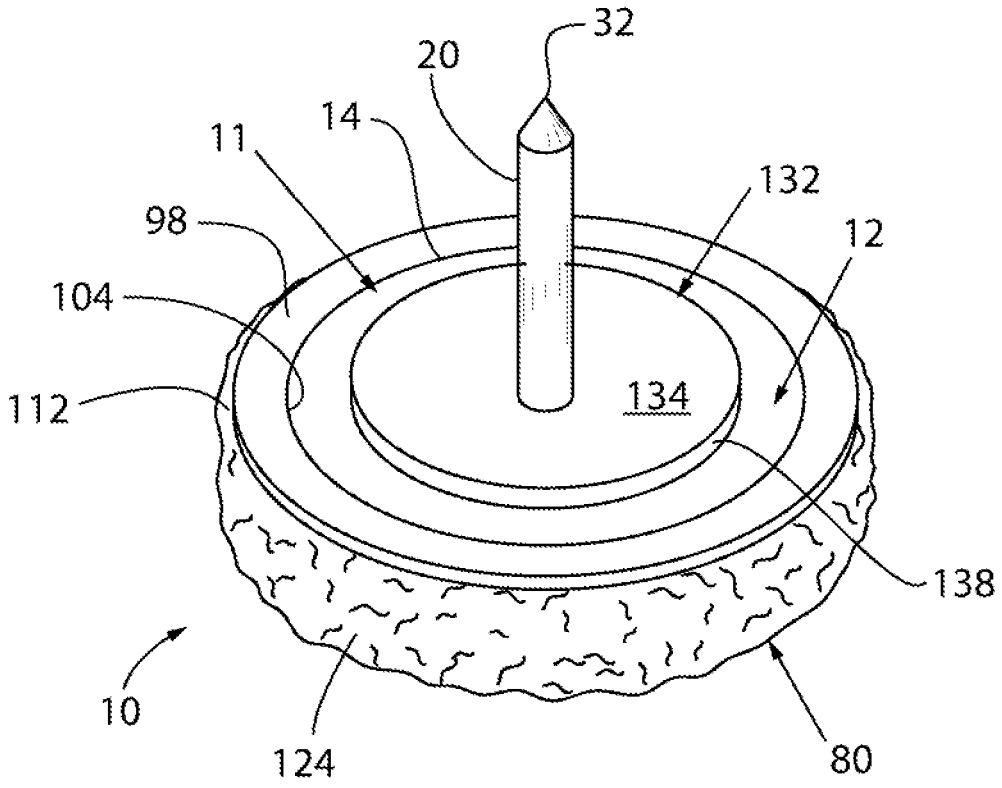
FIG. 18 is an isometric view the surface protection device in accordance of FIG. 14.
Figure 19:
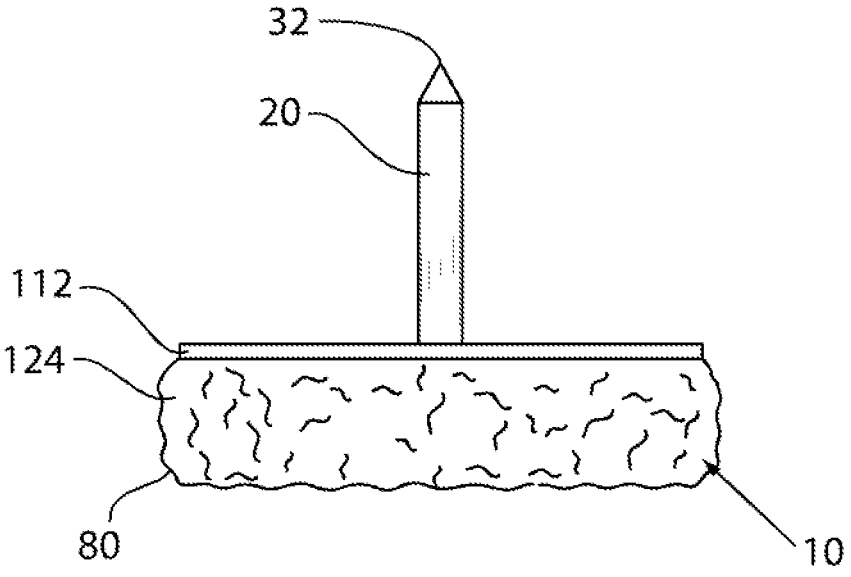
FIG. 19 is a side elevational view of the surface protection device of FIG. 18.
Figure 20:
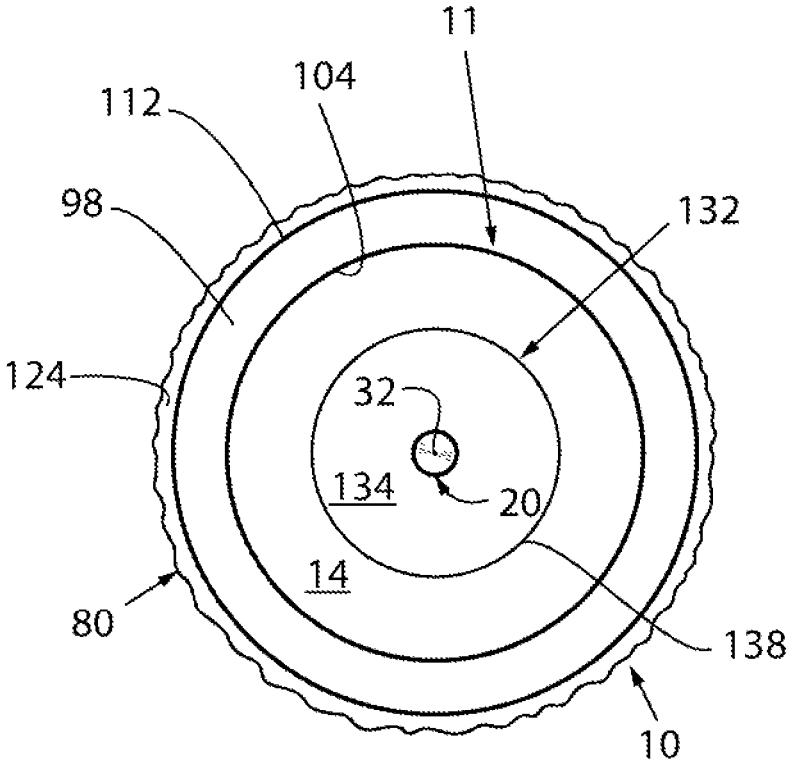
FIG. 20 is a top plan view of the surface protection device of FIG. 18.
Figure 21:
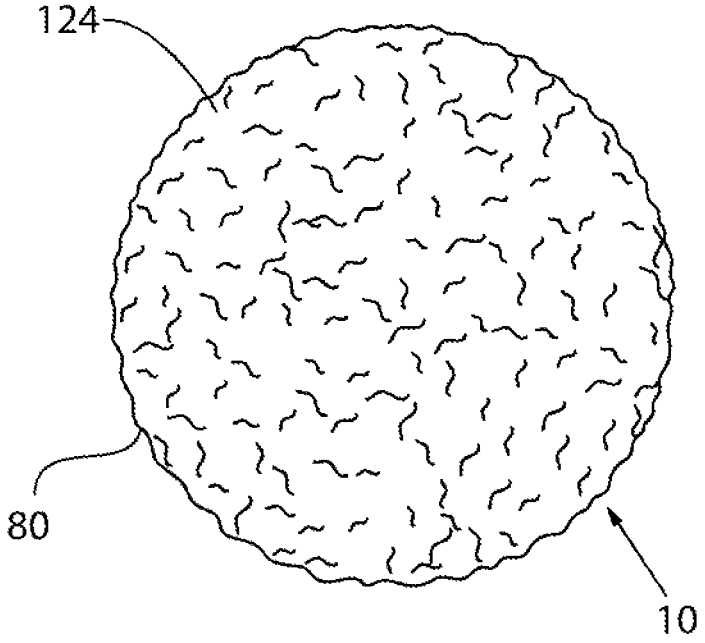
FIG. 21 is a bottom plan view of the surface protection device of FIG. 18.

Referring to FIGS. 11-13, it is intended that furniture glide 11 be mounted on terminal end 26 of a furniture leg 28 of a piece of furniture 29. Terminal end 26 of furniture leg 28 includes a generally flat terminal surface 30. In order to interconnect furniture glide 1 to furniture leg 28, terminal end 32 of nail 20 is positioned along terminal surface 30 of furniture leg 28 at a central location. Thereafter, a hammer or similar tool is used to engage and tap the lower surface 16 of base 12 of furniture glide 11 so as to urge nail 20 into terminal end 26 of furniture leg 28. Nail 20 is driven into terminal end 26 of furniture leg 28 until such point that upper surface 14 of base 12 engages terminal surface 30 of furniture leg 28, FIGS. 12-13. It is contemplated that nail be frictionally retained within terminal end 26 of furniture leg 28 in a conventional manner.

Referring to FIGS. 7-10, surface protection device 10 further includes an end cap, generally designated by the reference numeral 40. End cap 40 includes a base 42 having a generally flat upper surface 44, a generally flat bottom surface 46 and an outer periphery 48. Sidewall 50 extends vertically from upper surface 44 of base 42 at a location adjacent outer periphery 48 of base 42. Sidewall 50 includes an inner surface 52 and an outer surface 54 interconnected by upper face 56. Upper face 56 of sidewall 50 intersects inner surface 52 of sidewall 50 at an inner edge 58 which, in turn, defines an opening 60. Inner surface 52 of sidewall 50 and upper surface 44 of base 42 define cavity 62 in end cap 40 for receiving base 12 of furniture glide 11, as hereinafter described. It is contemplated for sidewall 50 to be fabricated from an elastic material such as vinyl so as to allow the diameter of opening 60 to increase in order for end cap 40 to accommodate and snuggly retain bases 12 of different shapes and sizes within cavity 62.

It is contemplated to cover bottom surface 46 of base 42 and outer surface 54 of sidewall 50 with matted material 64 such as felt. Preferably, matted material 64 is molded, imbedded or fused into bottom surface 46 of base 42 and outer surface 54 of sidewall 50 of end cap 40. An adhesive pad 66 is positioned on upper surface 44 of base 42 within the cavity 68. Adhesive pad 66 includes a lower surface 68 fixed by an adhesive to upper surface 44 of base 42 and an upper surface 70 having a layer of adhesive provided thereon. Adhesive pad 66 may be fabricated from one or more layers of any resilient type material, including plastic foam, felt or rubber.

In operation, in order to mount end cap 40 onto base 12 of furniture glide 11, base 12 of furniture glide 11 is inserted through opening 60 into cavity 62 of end cap 40. It is contemplated for sidewall 50 to expand to accommodate bases 12 of furniture glides 11 of different sizes, diameters and shapes and to snuggly retain end cap 40 on furniture glide 11. As base 12 of furniture glide 11 is inserted into cavity 62 in end cap 40, lower surface 16 of base 12 of furniture glide 11 engages and is bonded to upper surface 70 of adhesive pad 66, thereby securing end cap 40 on furniture glide 11, and hence, on terminal end 26 of furniture leg 28. Once surface protection device 10 has been secured to terminal end 26 of furniture leg 28, the piece of furniture may be positioned such that matted material 64 along bottom surface 46 of base 42 of end cap 40 engages supporting surface 72. Thereafter, the piece of furniture 29 may be slid along supporting surface 72 on surface protection device 10. It can be understood that unlike prior cup-type furniture glides wherein configuration of the internal cavity of the furniture glide corresponds to the terminal end of a piece of furniture received within a cavity of the furniture glide, the present invention allows for end cap 40 of surface protection device 10 to be mounted on the terminal end of a piece of furniture having different configurations. As such, end cap 40 of surface protection device 10 may have a diameter smaller than the diameter of the terminal end of the piece of furniture. This arrangement makes it more difficult to inadvertently kick end cap 40 of surface protection device 10 off the terminal end of the piece of furniture, a significant advantage over the art.

It can be appreciated that as the piece of furniture 29 is slid along supporting surface 72, sidewall 50 of end cap 40 acts to discourage end cap 40 from shearing off base 12 of furniture glide 11. In addition, it is understood that in the event that surface protection device 10 is mounted/positioned at an angle with respect to terminal end 26 of furniture leg 28 and/or end cap is mounted/positioned at an angle with respect to base 12 of furniture glide 11, matted material 64 along outer surface 54 of sidewall 50 of end cap 40 will engage supporting surface 72 thereby protecting supporting surface 72 and terminal end 26 of furniture leg 28 as the piece of furniture 29 is slid therealong.

Alternatively, it can appreciated that surface protection device 10 may be mounted to furniture leg 28 by initially mounting end cap 40 on furniture glide 11, as heretofore described. Thereafter, terminal end 32 of nail 20 may be positioned along terminal surface 30 of furniture leg 28 at a central location. A hammer or similar tool may then be used to engage and tap matted material 64 along bottom surface 46 of base 42 of end cap 40 so as to urge nail 20 into terminal end 26 of furniture leg 28. Nail 20 is driven into terminal end 26 of furniture leg 28 until such point that upper surface 14 of base 12 engages terminal surface 30 of furniture leg 28, FIGS. 12-13. It is contemplated that nail 20 be frictionally retained within terminal end 26 of furniture leg 28 in a conventional manner.

Referring to FIGS. 14-21, an alternate configuration of an end cap for surface protection device 10, generally designated by the reference numeral 80. End cap 80 includes base 82 having a generally flat upper surface 84, a generally flat bottom surface 86 and an outer periphery 88. Sidewall 90 extends vertically from upper surface 84 of base 82 at a location adjacent outer periphery 88 of base 82. Sidewall 90 includes an inner surface 92 and an outer surface 94 interconnected by upper edge 96.

Locking flange 98 extends radially inward from inner surface 92 of sidewall 90. Locking flange 98 includes an upper surface 100 coplanar with upper edge 96 of sidewall 90 and an lower surface 102 converging toward upper surface 100. A first end of lower surface 102 of locking flange 98 intersects inner surface 92 of sidewall 90 at intersection 108 and a second, opposite end of lower surface 102 of locking flange 98 intersects upper surface 100 of locking flange 98 at radially inner edge 104. Radially inner edge 104 of locking flange 98 defines opening 110 in communication with cavity 106 within end cap 80, hereinafter described. Intersection 108 along inner surface 92 of sidewall 90 is spaced from upper surface 84 of base 82 by a distance D1 generally equal to or greater than thickness T1 of base 12 of furniture glide 11, FIG. 6.

Inner surface 92 of sidewall 90, upper surface 94 of base 82, and lower surface 102 of locking flange 98 define cavity 106 in end cap 80 for receiving base 12 of furniture glide 11, as hereinafter described. Cavity 106 has a diameter D2 generally equal to or greater than diameter D3 of base 12 of furniture glide 11, FIG. 6. It is contemplated for sidewall 90 to be fabricated from an elastic material such as vinyl so as to allow the diameter of opening 110 to increase in order for end cap 80 to accommodate and snuggly retain bases 12 of different shapes and sizes within cavity 106.

Support flange 112 extends radially outward from outer surface 94 of sidewall 90 and includes an upper surface 114 coplanar with upper edge 96 of sidewall 90 and a lower surface 116 generally parallel to upper surface 114. A first end of lower surface 116 of support flange 112 intersects outer surface 94 of sidewall 90 at intersection 118 and a second, opposite end of lower surface 116 of support flange 112 is interconnected to upper surface 114 of support flange 112 by radially outer edge 120. Radially outer edge 120 of support flange 112 is generally perpendicular to upper and lower surfaces 114 and 116, respectively, of support flange 112.

It is contemplated to cover bottom surface 86 of base 82 and outer surface 94 of sidewall 90 with matted material 124 such as felt. Preferably, matted material 124 is molded, imbedded or fused into bottom surface 86 of base 82 and outer surface 94 of sidewall 90 of end cap 80. An adhesive pad 126 may be positioned on upper surface 84 of base 82 within the cavity 106. Adhesive pad 126 includes a lower surface 128 fixed by an adhesive to upper surface 84 of base 82 and an upper surface 130 having a layer of adhesive provided thereon. Adhesive pad 126 may be fabricated from one or more layers of any resilient type material, including plastic foam, felt or rubber.

In operation, in order to mount end cap 80 on base 12 of furniture glide 11, spacer 132 is positioned on upper surface 14 of base 12. More specifically, spacer 132 has a generally disc-shaped configuration defined by a generally flat upper surface 134 and a generally flat lower surface 136 interconnected by outer peripheral edge 138. It is contemplated for spacer 132 to have a diameter D4 less than the diameter D5 of opening 110 in end cap 80. In addition, it is contemplated for spacer 132 to have a thickness T2 greater than the thickness of locking flange 98. Aperture 140 extends through center of spacer 132 along an axis generally perpendicular upper surface 134 and lower surface 136. Nail 20 is inserted through aperture 140 in spacer 132 such that lower surface 136 of spacer 132 is received on upper surface 14 of base 12.

In order to interconnect furniture glide 11 to furniture leg 28, terminal end 32 of nail 20 is positioned along terminal surface 30 of furniture leg 28 at a central location. Thereafter, a hammer or similar tool is used to engage and tap the lower surface 16 of base 12 of furniture glide 11 so as to urge nail 20 into terminal end 26 of furniture leg 28. Nail 20 is driven into terminal end 26 of furniture leg 28 until such point that upper surface 134 of spacer 132 engages terminal surface 30 of furniture leg 28, FIGS. 16-17, thereby providing a gap between upper surface 14 of base 12 adjacent outer peripheral edge 18 to allow for locking flange 98 of end cap 80 to be received therein, as hereinafter described. It is contemplated that nail 20 be frictionally retained within terminal end 26 of furniture leg 28 in a conventional manner.

Thereafter, base 12 of furniture glide 11 is inserted through opening 110 into cavity 106 of end cap 80. It is contemplated for sidewall 90 to expand to accommodate bases 12 of furniture glides 11 of different sizes, diameters and shapes and to snuggly retain end cap 80 on furniture glide 11. As base 12 of furniture glide 11 is inserted through opening 110 into cavity 106 in end cap 80, lower surface 16 of base 12 of furniture glide 11 engages and is bonded to upper surface 130 of adhesive pad 126, thereby securing end cap 80 on furniture glide 11, and hence, on terminal end 26 of furniture leg 28. It can be appreciated that lower surface 102 of locking flange 98 overlaps upper surface 14 of base 12, thereby further retaining end cap 80 on furniture glide 11.

Once surface protection device 10 has been secured to terminal end 26 of furniture leg 28, the piece of furniture may be positioned such that matted material 124 along bottom surface 86 of base 82 of end cap 80 engages supporting surface 72. Thereafter, the piece of furniture 29 may be slid along supporting surface 72 on surface protection device 10. As previously noted, as the piece of furniture 29 is slid along supporting surface 72, sidewall 90 of end cap 80 acts to discourage end cap 80 from shearing off base 12 of furniture glide 11. In addition, it is understood that in the event that surface protection device 10 is mounted/positioned at an angle with respect to terminal end 26 of furniture leg 28 and/or end cap 80 is mounted/positioned at an angle with respect to base 12 of furniture glide 11, matted material 124 along outer surface 94 of sidewall 90 of end cap 80 will engage supporting surface 72 thereby protecting supporting surface 72 and terminal end 26 of furniture leg 28 as the piece of furniture 29 is slid therealong.

Figure 22:
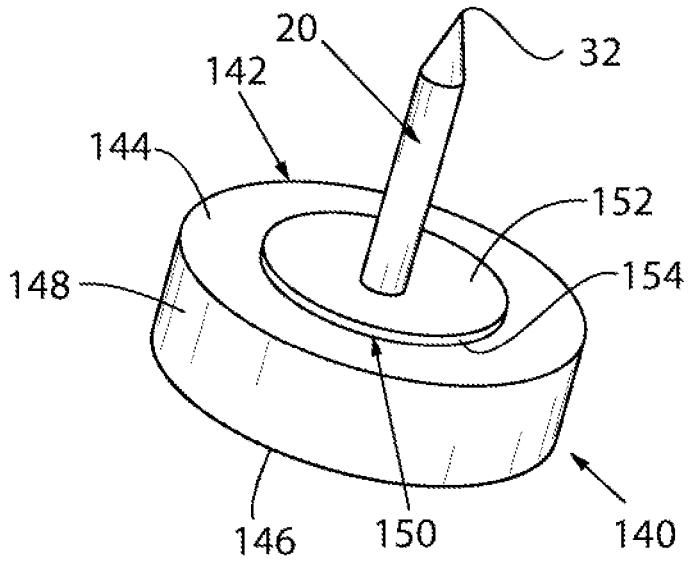
FIG. 22 is an isometric view of an alternate configuration of a furniture glide for the surface protection device of the present invention.
Figure 23:
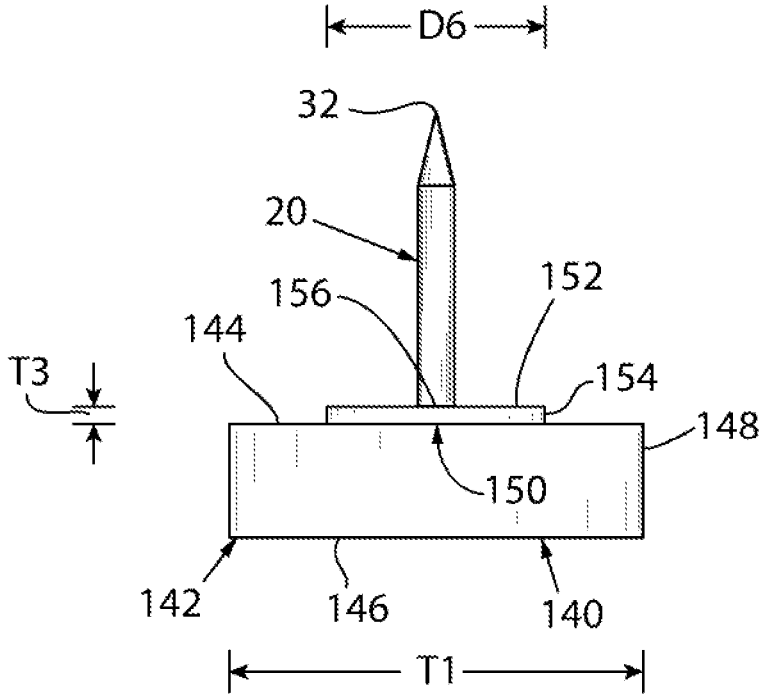
FIG. 23 is a side elevational view of the furniture glide of FIG. 22.

Referring to FIGS. 22-23, an alternate configuration of a furniture glide for surface protection device 10, generally designated by the reference numeral 140. Furniture glide 140 is defined by a generally disc-shaped base 142 having an upper surface 144 and a generally flat lower surface 146 interconnected by outer peripheral edge 148. Spacer 150 is integrally molded on upper surface 144 of base 142. Spacer 150 has a generally disc-shaped configuration defined by a generally flat upper surface 152 and an outer peripheral edge 154 interconnecting upper surface 152 of spacer 150 to upper surface 144 of base 142.

It is contemplated for spacer 150 to have a diameter D6 less than the diameter D5 of opening 110 in end cap 80. In addition, it is contemplated for outer peripheral edge 154 of spacer 152 to have a thickness T3 greater than the thickness of locking flange 98. A fastening mechanism, such as nail 20, projects vertically from center 156 of upper surface 152 of spacer 150 along a corresponding axis perpendicular to upper surface 152. Nail 20 includes head 24 captured within the interior of base 12 so as to interconnect nail 20 thereto.

Figure 24:
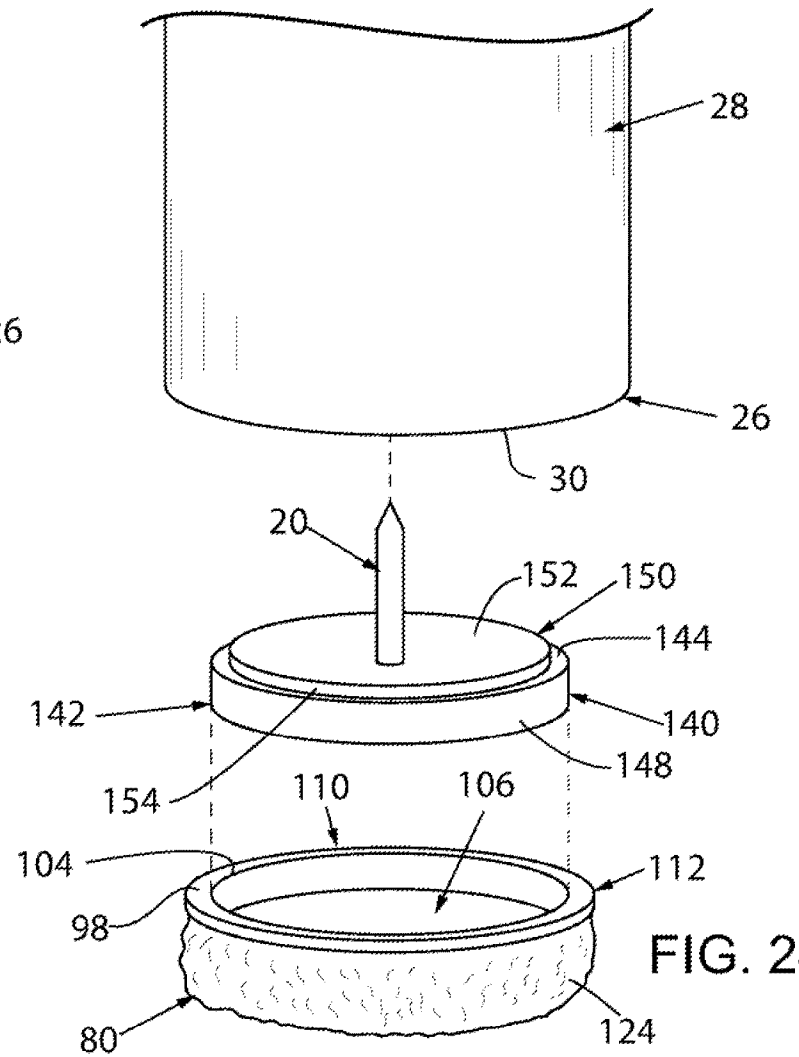
FIG. 24 is an exploded isometric view of the surface protection device in accordance with the present invention including the furniture glide of FIG. 22.
Figure 25:
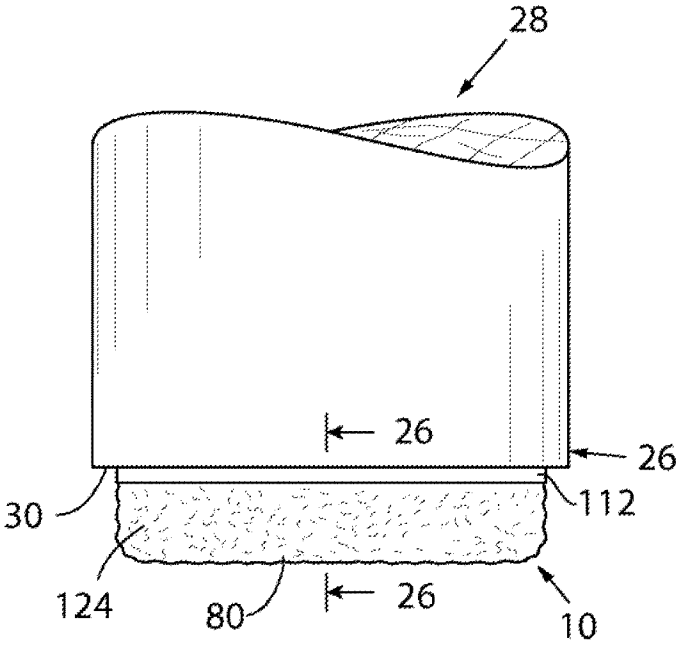
FIG. 25 is a side elevational view of the surface protection device of FIG. 24 mounted on the furniture leg.
Figure 26:
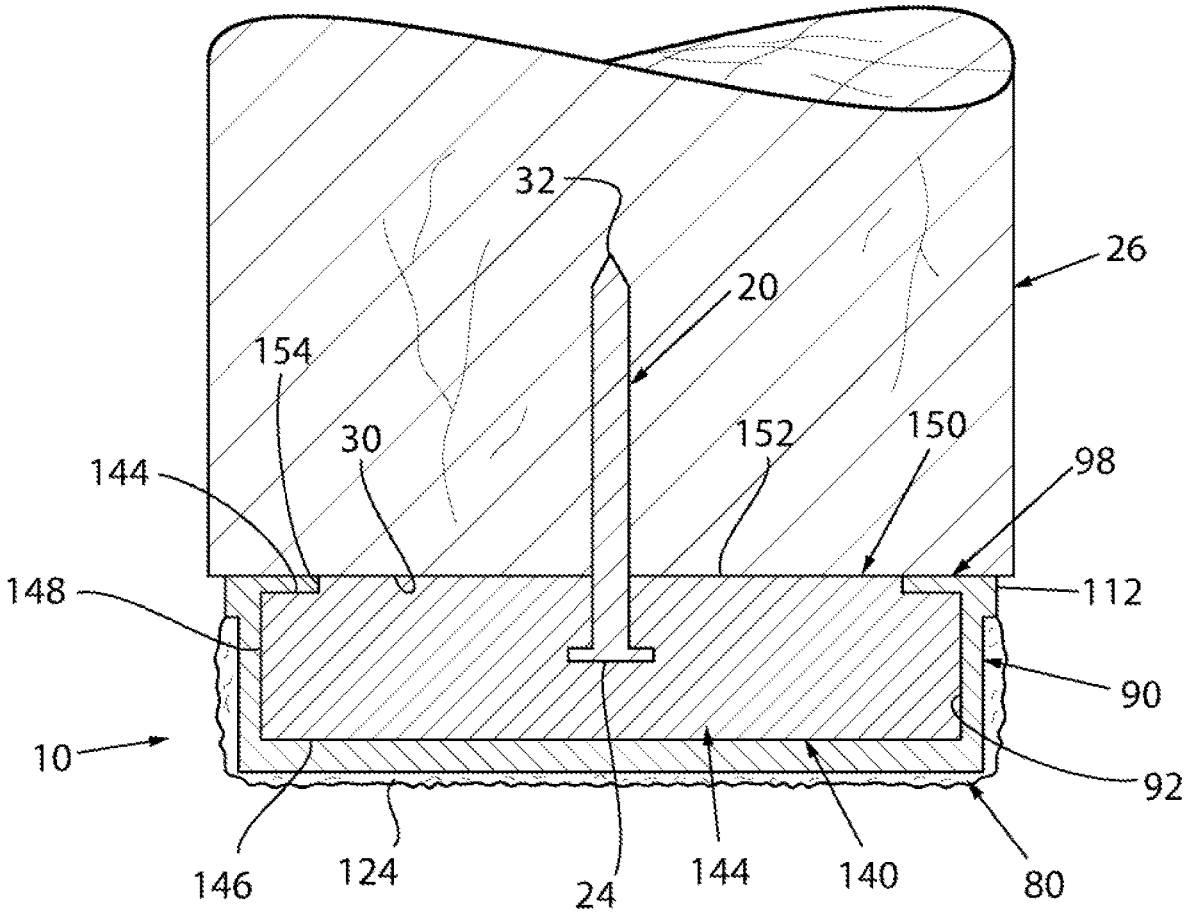
FIG. 26 is a cross-sectional view of the surface protection device of the present invention taken along line 26-26 of FIG. 25.

Referring to FIGS. 24-26, in order to interconnect furniture glide 140 to furniture leg 28, terminal end 32 of nail 20 is positioned along terminal surface 30 of furniture leg 28 at a central location. Thereafter, a hammer or similar tool is used to engage and tap the lower surface 146 of base 142 of furniture glide 140 so as to urge nail 20 into terminal end 26 of furniture leg 28. Nail 20 is driven into terminal end 26 of furniture leg 28 until such point that upper surface 152 of spacer 150 engages terminal surface 30 of furniture leg 28, FIGS. 25-26, thereby providing a gap between upper surface 142 of base 144 adjacent outer peripheral edge 148 to allow for locking flange 98 of end cap 80 to be received therein, as hereinafter described. It is contemplated that nail 20 be frictionally retained within terminal end 26 of furniture leg 28 in a conventional manner.

Thereafter, base 144 of furniture glide 140 is inserted through opening 110 into cavity 106 of end cap 80. It is contemplated for sidewall 90 to expand to accommodate bases 144 of furniture glides 140 of different sizes, diameters and shapes and to snuggly retain end cap 80 on furniture glide 140. As base 144 of furniture glide 140 is inserted through opening 110 into cavity 106 in end cap 80, lower surface 146 of base 144 of furniture glide 140 engages and is bonded to upper surface 130 of adhesive pad 126, thereby securing end cap 80 on furniture glide 140, and hence, on terminal end 26 of furniture leg 28. It can be appreciated that lower surface 102 of locking flange 98 overlaps upper surface 144 of base 142, thereby further retaining end cap 80 on furniture glide 140, FIG. 26.

Once surface protection device 10 has been secured to terminal end 26 of furniture leg 28, the piece of furniture may be positioned such that matted material 124 along bottom surface 86 of base 82 of end cap 80 engages supporting surface 72. Thereafter, the piece of furniture 29 may be slid along supporting surface 72 on surface protection device 10. As previously noted, as the piece of furniture 29 is slid along supporting surface 72, sidewall 90 of end cap 80 acts to discourage end cap 80 from shearing off base 142 of furniture glide 140. In addition, it is understood that in the event that surface protection device 10 is mounted/positioned at an angle with respect to terminal end 26 of furniture leg 28 and/or end cap 80 is mounted/positioned at an angle with respect to base 142 of furniture glide 140, matted material 124 along outer surface 94 of sidewall 90 of end cap 80 will engage supporting surface 72 thereby protecting supporting surface 72 and terminal end 26 of furniture leg 28 as the piece of furniture 29 is slid therealong.

Various modes of carrying out the invention are contemplated as being within the scope of the following claims particularly pointing out and distinctly claiming the subject matter that is regarded as the invention.

I claim:

1. A surface protection device for mounting on a terminal end of a furniture leg, comprising:

a furniture glide base having an upper surface directable toward the terminal end of the furniture leg and a lower surface interconnected by an outer periphery, the upper surface of the furniture glide base and the lower surface of the furniture glide base defining a thickness of the furniture glide base therebetween;

a fastener extending from the furniture glide base along an axis and having a first end and a second end receivable in the terminal end of the furniture leg for frictionally connecting the furniture glide base to the furniture leg; and an end cap receivable on the furniture glide base, the end cap including:

an end cap base having an upper surface, a lower surface and an outer periphery;

a sidewall extending from the outer periphery of the end cap base and having an inner surface defining a cavity adapted for receiving the furniture glide base therein, the cavity having a depth greater than or equal to the thickness of the furniture glide base; and a matted material molded into the lower surface of the end cap base and the outer surface of the sidewall;

wherein:

the first end of the fastener is captured within an interior of the furniture glide base;

the sidewall terminates at a terminal edge; and the surface protection device further includes a flange extending from the inner surface of sidewall adjacent the terminal edge, the flange terminating at a radially inner edge defining an opening to the cavity in the end cap.

2. The surface protection device of claim 1 wherein the furniture glide base has a generally circular configuration and a diameter.

3. The surface protection device of claim 2 wherein the cavity of the end cap has a diameter, the diameter of the end cap being generally equal to the diameter of the furniture glide base.

4. The surface protection device of claim 1 wherein the sidewall of the end cap includes an outer surface, the inner and outer surfaces of the end cap being generally parallel.

5. The surface protection device of claim 1 further comprising an adhesive on the upper surface of the base, the adhesive engageable with the lower surface of the furniture glide base.

6. The surface protection device of claim 1 wherein the sidewall is fabricated from an elastic material.

7. The surface protection device of claim 1 further comprising a spacer receivable on the upper surface of the furniture glide base, the spacer configured to space the upper surface of the furniture glide base from the terminal end of the furniture leg when the fastener frictionally connecting the furniture glide base to the furniture leg.

8. The surface protection device of claim 1 further comprising a spacer integrally formed on the upper surface of the furniture glide base, the spacer configured to space the upper surface of the furniture glide base from the terminal end of the furniture leg when the fastener frictionally connecting the furniture glide base to the furniture leg.

9. A surface protection device for mounting on a terminal end of a furniture leg, comprising:

a furniture glide base having an upper surface directable toward the terminal end of the furniture leg and a lower surface interconnected by an outer periphery, the upper surface of the furniture glide base and the lower surface of the furniture glide base defining a thickness of the furniture glide base therebetween;

a fastener extending from the furniture glide base along an axis and having a first end and a second end receivable in the terminal end of the furniture leg for frictionally connecting the furniture glide base to the furniture leg; and an end cap receivable on the furniture glide base, the end cap including:

an end cap base having an upper surface, a lower surface and an outer periphery;

a sidewall extending from the outer periphery of the end cap base and having an inner surface defining a cavity adapted for receiving the furniture glide base therein, the cavity having a depth greater than or equal to the thickness of the furniture glide base; and a matted material molded into the lower surface of the base and the outer surface of the sidewall;

wherein:

the sidewall terminates at a terminal edge;

the surface protection device further includes a flange extending from the inner surface of sidewall adjacent the terminal edge, the flange terminating at a radially inner edge defining an opening to the cavity in the end cap; and the flange is defined by a first upper surface generally coplanar with the terminal edge of the sidewall and a second lower surface.

10. The surface protection device of claim 9 wherein the first upper surface of the flange and the second lower surface of the flange converge toward each other as the flange extends from the inner surface of the sidewall.

11. A surface protection device for mounting on a terminal end of a furniture leg, comprising:

a furniture glide including:

a furniture glide base having an upper surface directable towards the terminal end of the furniture leg and a lower surface interconnected by an outer periphery, the upper surface of the furniture glide base and the lower surface of the furniture glide base defining a thickness of the furniture glide base therebetween; and a fastener extending from the furniture glide base along an axis and having a first end and a second end receivable in the terminal end of the furniture leg for frictionally connecting the furniture glide base to the furniture leg;

a cup having an outer surface and an inner surface defining a cavity for receiving the furniture glide base therein, the cavity having a depth greater than or equal to the thickness of the furniture glide base; and matted material molded into the outer surface of the cup;

wherein:

the first end of the fastener is captured within an interior of the furniture glide base;

the cup includes:

a base portion having an upper surface, a lower surface and an outer periphery; and a sidewall extending from the outer periphery of the base and having an inner surface and an outer surface;

the sidewall terminates at a terminal edge; and the surface protection device further includes a flange extending from the inner surface of sidewall adjacent the terminal edge, the flange terminating at a radially inner edge defining an opening to the cavity in the cup.

12. The surface protection device of claim 11 wherein the inner and outer surfaces of the sidewall of the cup are generally parallel.

13. The surface protection device of claim 11 wherein the sidewall of the cup has a generally uniform thickness.

14. The surface protection device of claim 11 further comprising an adhesive on the upper surface of the base, the adhesive engageable with the lower surface of the furniture glide base.

15. The surface protection device of claim 11 further comprising a spacer receivable on the upper surface of the furniture glide base, the spacer configured to space the upper surface of the furniture glide base from the terminal end of the furniture leg when the fastener frictionally connecting the furniture glide base to the furniture leg.

16. The surface protection device of claim 11 further comprising a spacer integrally formed on the upper surface of the furniture glide base, the spacer configured to space the upper surface of the furniture glide base from the terminal end of the furniture leg when the fastener frictionally connecting the furniture glide base to the furniture leg.

17. The surface protection device of claim 11 where the sidewall of the cup is fabricated from an elastic material.

18. A surface protection device for mounting on a terminal end of a furniture leg, comprising:

a furniture glide including:

a furniture glide base having an upper surface directable towards the terminal end of the furniture leg and a lower surface interconnected by an outer periphery, the upper surface of the furniture glide base and the lower surface of the furniture glide base defining a thickness of the furniture glide base therebetween; and a fastener extending from the furniture glide base along an axis and having a first end and a second end receivable in the terminal end of the furniture leg for frictionally connecting the furniture glide base to the furniture leg;

a cup having an outer surface and an inner surface defining a cavity for receiving the furniture glide base therein, the cavity having a depth greater than or equal to the thickness of the furniture glide base; and matted material molded into the outer surface of the cup;

wherein:

the sidewall terminates at a terminal edge;

the surface protection device further includes a flange extending from the inner surface of sidewall adjacent the terminal edge, the flange terminating at a radially inner edge defining an opening to the cavity in the cup; and the flange is defined by a first upper surface generally coplanar with the terminal edge of the sidewall and a second lower surface.

19. The surface protection device of claim 18 wherein the first upper surface of the flange and the second lower surface of the flange converge toward each other as the flange extends from the inner surface of the sidewall.

20. A method of interconnecting a surface protection device to a terminal end of a piece of furniture, comprising:

interconnecting an end cap to a furniture glide; and interconnecting the furniture glide to the terminal end of the piece of furniture such that the end cap interconnected to the furniture glide engages the terminal end of the piece of furniture;

wherein:

the furniture glide includes:

a furniture glide base having an upper surface directed towards the terminal end of the furniture leg and a lower surface interconnected by an outer periphery; and a fastener extending from the furniture glide base along an axis and having a first end and a second end receivable in the terminal end of a piece of furniture to frictionally interconnect the furniture glide base to the terminal end of a piece of furniture;

the method includes the additional step of capturing the first end of the fastener within an interior of the furniture glide base;

the end cap includes:

an end cap base having an upper surface, a lower surface and an outer periphery;

a sidewall extending from the outer periphery of the end cap base and having an inner surface defining a cavity adapted for receiving the furniture glide base therein; and a matted material molded into the lower surface of the base and the outer surface of the sidewall; and the sidewall terminates at a terminal edge and a flange extends from the inner surface of sidewall adjacent the terminal edge, the flange terminates at a radially inner edge defining an opening to the cavity in the end cap.

21. The method of claim 20 wherein the inner and outer surfaces of the sidewall of the end cap are generally parallel.

22. The method of claim 20 wherein the sidewall of the end cap has a generally uniform thickness.

23. The method of claim 20 further comprising an adhesive on the upper surface of the base, the adhesive engageable with the lower surface of the furniture glide base.

24. The method of claim 20 comprising the additional step of positioning a spacer on the upper surface of the furniture glide base, the spacer configured to space the upper surface of the furniture glide base from the terminal end of a piece of furniture when interconnected.

25. The method of claim 20 comprising the additional step of integrally forming a spacer on the upper surface of the furniture glide base, the spacer configured to space the upper surface of the furniture glide base from the terminal end of a piece of furniture when interconnected.

26. The method of claim 20 where the sidewall of the end cap is fabricated from an elastic material.

27. A method of interconnecting a surface protection device to a terminal end of a piece of furniture, comprising:

interconnecting an end cap to a furniture glide; and interconnecting the furniture glide to the terminal end of the piece of furniture such that the end cap interconnected to the furniture glide engages the terminal end of the piece of furniture;

wherein:

the furniture glide includes:

a furniture glide base having an upper surface directed towards the terminal end of the furniture leg and a lower surface interconnected by an outer periphery; and a fastener extending from the furniture glide base along an axis and having a first end and a second end receivable in the terminal end of a piece of furniture to frictionally interconnect the furniture glide base to the terminal end of a piece of furniture;

the end cap includes:

an end cap base having an upper surface, a lower surface and an outer periphery;

a sidewall extending from the outer periphery of the end cap base and having an inner surface defining a cavity adapted for receiving the furniture glide base therein; and a matted material molded into the lower surface of the base and the outer surface of the sidewall;

the sidewall terminates at a terminal edge and a flange extends from the inner surface of sidewall adjacent the terminal edge, the flange terminates at a radially inner edge defining an opening to the cavity in the end cap; and the flange is defined by a first upper surface generally coplanar with the terminal edge of the sidewall and a second lower surface.

28. A method of interconnecting a surface protection device to a terminal end of a piece of furniture, comprising:

interconnecting an end cap to a furniture glide; and interconnecting the furniture glide to the terminal end of the piece of furniture such that the end cap interconnected to the furniture glide engages the terminal end of the piece of furniture;

wherein:

the furniture glide includes:

a furniture glide base having an upper surface directed towards the terminal end of the furniture leg and a lower surface interconnected by an outer periphery; and a fastener extending from the furniture glide base along an axis and having a first end and a second end receivable in the terminal end of a piece of furniture to frictionally interconnect the furniture glide base to the terminal end of a piece of furniture;

the end cap includes:

an end cap base having an upper surface, a lower surface and an outer periphery;

a sidewall extending from the outer periphery of the end cap base and having an inner surface defining a cavity adapted for receiving the furniture glide base therein; and a matted material molded into the lower surface of the base and the outer surface of the sidewall;

the sidewall terminates at a terminal edge and a flange extends from the inner surface of sidewall adjacent the terminal edge, the flange terminates at a radially inner edge defining an opening to the cavity in the end cap; and the first upper surface of the flange and the second lower surface of the flange converge toward each other as the flange extends from the inner surface of the sidewall.

* * * * *